US008813995B2

(12) United States Patent
Kim et al.

(10) Patent No.: US 8,813,995 B2
(45) Date of Patent: Aug. 26, 2014

(54) REFRIGERATOR AND REFRIGERATOR DOOR

(75) Inventors: Hyun-Cheol Kim, Changwon (KR); Chang-Lim Lee, Changwon (KR); Boo-Youn Lee, Changwon (KR); Sang-Hu Park, Changwon (KR)

(73) Assignee: LG Electronics Inc., Seoul (KR)

( * ) Notice: Subject to any disclaimer, the term of this patent is extended or adjusted under 35 U.S.C. 154(b) by 765 days.

(21) Appl. No.: 12/673,137

(22) PCT Filed: Aug. 27, 2008

(86) PCT No.: PCT/KR2008/005018

§ 371 (c)(1),
(2), (4) Date: Feb. 11, 2010

(87) PCT Pub. No.: WO2009/028866

PCT Pub. Date: Mar. 5, 2009

(65) Prior Publication Data

US 2011/0220662 A1 Sep. 15, 2011

(30) Foreign Application Priority Data

Aug. 27, 2007 (KR) ..... 10-2007-0086089

(51) Int. Cl.
*E05B 1/00* (2006.01)

(52) U.S. Cl.
USPC ..... 220/592.02; 16/412; 312/405

(58) Field of Classification Search
USPC ..... 16/412, 436; 312/405; 220/592.02, 759
See application file for complete search history.

(56) References Cited

U.S. PATENT DOCUMENTS

| | | | | |
|---|---|---|---|---|
| 3,523,322 | A * | 8/1970 | Rossow | 16/412 |
| 4,912,809 | A * | 4/1990 | Scheuer | 16/413 |
| 6,966,101 | B2 | 11/2005 | Chiang | |
| 7,685,675 | B2 | 3/2010 | Jung et al. | |
| 7,793,388 | B2 * | 9/2010 | Wing | 16/412 |
| 7,992,257 | B2 * | 8/2011 | Kim | 16/412 |

FOREIGN PATENT DOCUMENTS

| | | | |
|---|---|---|---|
| JP | 09-067917 | A | 3/1997 |
| JP | 10-169138 | A | 6/1998 |
| KR | 20-2000-0011237 | U | 6/2000 |
| KR | 10-2004-0059095 | A | 7/2004 |
| KR | 10-2006-0054929 | A | 5/2006 |

* cited by examiner

*Primary Examiner* — Stephen Castellano
(74) *Attorney, Agent, or Firm* — Birch, Stewart, Kolasch & Birch, LLP

(57) ABSTRACT

Provided is a refrigerator and a refrigerator door. The refrigerator includes a main body configured to form a storage space, a door configured to selectively open and close the storage space, handle fixing parts coupled to the door and protruding from the door, a door handle disposed at the door and configured to be grasped by a user for opening and closing the door, holders disposed at both sides of the door handle for receiving the handle fixing parts, and a detachment preventing part. The detachment preventing part is coupled to a side of the holder at an acute angle with a front surface of the door and is configured to be locked by the handle fixing part for fixing the door handle. The door handle can be attached to the door more easily and firmly.

13 Claims, 3 Drawing Sheets

REFRIGERATOR AND REFRIGERATOR DOOR

This application is a national stage (Rule 371) of PCT/KR08/05018 filed Aug. 27, 2008.

TECHNICAL FIELD

The present disclosure relates to a refrigerator and a refrigerator door.

BACKGROUND ART

Refrigerators are used to store foods at low temperatures and are configured to refrigerate or freeze foods for storing the foods optimally.

The inside of a refrigerator is kept at a low temperature by low-temperature air, which is continuously supplied to the inside of the refrigerator after being cooled by heat-exchange with refrigerant undergoing a compression-condensation-expansion-evaporation cycle.

The trends in recent refrigerators are size-up and multi-functionalization based on various user demands and changes in eating habits, and thus products having various configurations are being introduced to the market.

According to the type of a refrigerator, refrigerator and freezer compartments of the refrigerator are differently located: for example, the freezer compartment is located above the refrigerator compartment; the freezer compartment is located under the refrigerator compartment; or the freezer and refrigerator compartments are transversely arranged.

The inside of the refrigerator divided into the freezer and refrigerator compartments is closed by freezer and refrigerator doors, and the freezer and refrigerator doors can be opened by rotating or sliding them according to the type of the refrigerator.

Door handles are attached to the freezer and refrigerator doors so that a user can easily open the freezer and refrigerator doors by rotating or sliding them using the door handles.

A user holds the door handle and applies a force to the door handle in a predetermined direction to open the door. At this time, if the door handle is not firmly fixed to the door, the door handle is moved relative to the door in the force direction, thereby making it uneasy to open the door and increasing a force necessary to open the door.

Furthermore, the relative movement of the door handle to the door, which is caused by infirm attachment of the door handle to the door, is increased in proportion to the number of door opening activities, and thus the possibility of breakage of the door handle and the door increases.

Moreover, in the related art, the door and the door handle are coupled using a somewhat complex structure and inefficient assembling method. In addition, after the door hand is fixed to the door, a side of the door handle opposite to a side fixed to the door can come off from the door.

DISCLOSURE OF INVENTION

Technical Problem

Embodiments provide a refrigerator door handle coupling structure for increasing assembling efficiency by coupling a handle fixing part and a detachment preventing part at predetermined angles.

Embodiments also provide a refrigerator door handle coupling structure for firmly fixing a door handle by forming an inclined surface at an end of a detachment preventing part to increase a contact area between the detachment preventing part and a handle fixing part.

Technical Solution

In one embodiment, a refrigerator including: a main body configured to form a storage space; a door configured to selectively open and close the storage space; handle fixing parts coupled to the door and protruding from the door; a door handle disposed at the door and configured to be grasped by a user for opening and closing the door; holders disposed at both sides of the door handle for receiving the handle fixing parts; and a detachment preventing part coupled to a side of the holder at an acute angle with a front surface of the door, the detachment preventing part being configured to be locked by the handle fixing part for fixing the door handle.

In another embodiment, a refrigerator including: a main body configured to form a storage space; a door configured to selectively open and close the storage space; a door handle configured to be grasped by a user for opening and closing the door; handle fixing parts coupled to the door and inserted into both sides of the door handle; a detachment preventing part coupled to the door handle and configured to lock the handle fixing part for fixing the door handle to the door; and an inclined contact portion disposed at an end of the detachment preventing part and configured to make tight contact with the handle fixing part.

In further another embodiment, a refrigerator including: a main body; a door openably attached to the main body and including a door handle; handle fixing parts coupled to the door and inserted into the door handle; holders disposed at both sides of the door handle for receiving portions of the handle fixing parts; a detachment preventing part coupled to an outer side of the door handle and locked by the handle fixing part; and a movement restricting part disposed at an inner side of the holder opposite to the detachment preventing part for restricting movement of the handle fixing part.

In still further another embodiment, a refrigerator door including: an outer case forming an exterior of the refrigerator door; a door handle coupled to the outer case and configured to be grasped by a user; a handle fixing part coupled to the outer case and inserted into the door handle; a confinement portion formed by inwardly recessing a side of the handle fixing part; a detachment preventing part penetration hole formed at an oblique angle from an outer side of the door handle to a position where the handle fixing part is inserted; a detachment preventing part coupled to the detachment preventing part penetration hole and including an upper portion configured to interfere with the confinement portion for fixing the door handle; and a contact portion disposed at an end of the detachment preventing part and inclined corresponding to a side of the confinement part for making contact with the side of the confinement part.

The details of one or more embodiments are set forth in the accompanying drawings and the description below. Other features will be apparent from the description and drawings, and from the claims.

Advantageous Effects

According to embodiments, assembling efficiency improves because the detachment preventing part is coupled at a predetermined to lock the handle fixing part which is fixed to the door and inserted into the door handle.

Furthermore, since the handle fixing part and the detachment preventing part have inclined surfaces corresponding to each other, the door handle can be fixed more securely by bringing the inclined surfaces into contact with each other.

In this way, the door handle can be securely fixed to the door, and thus the door handle does not come off the door although the door is repeatedly used for a long time.

BEST MODE FOR CARRYING OUT THE INVENTION

Reference will now be made in detail to the embodiments of the present disclosure, examples of which are illustrated in the accompanying drawings.

A refrigerator door handle coupling structure of the present disclosure can be applied to various types of refrigerators such as a side-by-side type refrigerator, a top mount type refrigerator, and a bottom freezer type refrigerator, and the position and direction of the refrigerator door handle coupling structure may vary according to the types of the refrigerators. However, the following explanation will be given mainly on the bottom freeze type refrigerator for the convenience of description and providing better understanding of the present disclosure.

Figure 1:
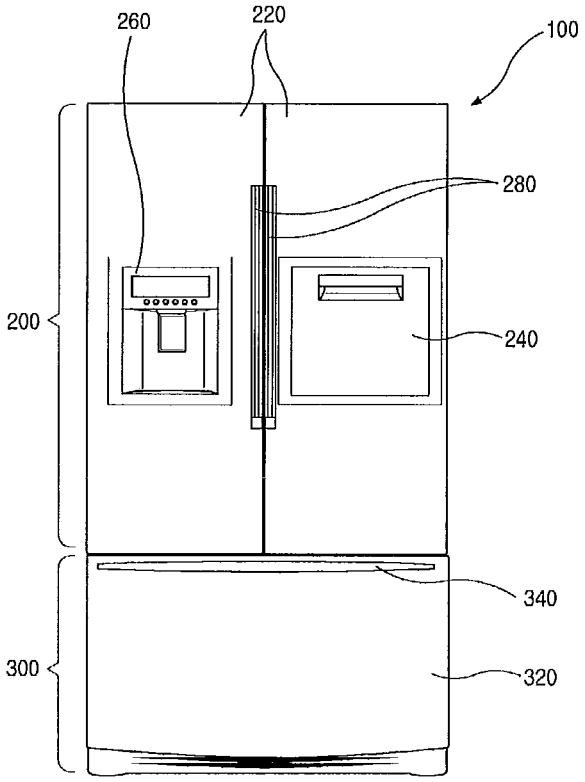
FIG. 1 is a front view illustrating a refrigerator according to an embodiment.
Figure 2:
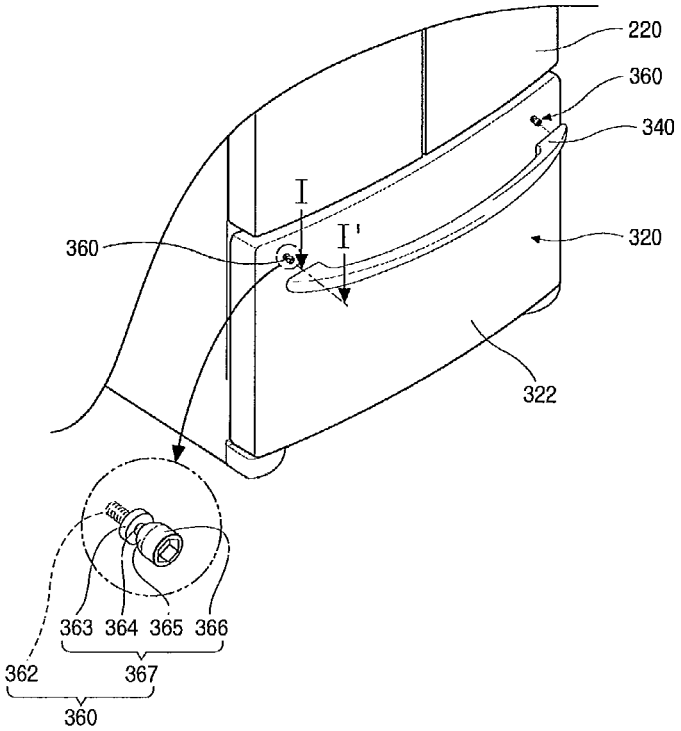
FIG. 2 is an exploded perspective view illustrating a door handle coupling structure according to an embodiment.

FIG. 1 is a front view illustrating a refrigerator 100 according to an embodiment, and FIG. 2 is an exploded perspective view illustrating a door handle coupling structure according to an embodiment.

Referring to FIGS. 1 and 2, the refrigerator 100 of the current embodiment is vertically divided into a refrigerator compartment 200 and a freezer compartment 300. Two refrigerator doors 220 are attached to the refrigerator compartment 200 and can be opened by rotating them in the right and left directions, respectively. A freezer door 320 is attached to the freezer compartment 300 and can be closed and opened by sliding it forward and backward.

Optionally, a home bar 240 and a dispenser 260 can be provided at the two refrigerator doors 220 for providing convenience use of the refrigerator 100. Drinks or foods can be easily placed into and taken out of the refrigerator compartment 200 through the home bar 240, and ice or water can be dispensed through the dispenser 260.

Refrigerator door handles 280 elongated in the length direction (vertical direction) of the refrigerator doors 220 are respectively attached to the refrigerator doors 220 so that a user can easily rotate the refrigerator doors 220 left and right, and a freezer door handle 340 elongated in the length direction (horizontal direction) of the freezer door 320 is attached to the freezer door 320.

Hereinafter, a further detailed description of the current embodiment will be made mainly on the freezer door handle 340.

The freezer door handle 340 has a horizontally elongated shape and is attached to an outer case 322 forming the front of the freezer door 320. Both left and right sides of the freezer door handle 340 are fixed to the freezer door 320, and the other portion of the freezer door handle 340 is spaced apart from the front surface of the freezer door 320. Therefore, a user can easily hold the freezer door handle 340.

In the state where both sides of the freezer door handle 340 are fixed to the front surface of the freezer door 320, the center portion of the freezer door handle 340 may be maximally protruded in a forward direction as compared with the other portion of the freezer door handle 340. In this case, the freezer door handle 340 may have a predetermined curvature.

The freezer door handle 340 may be formed of a metallic material such as aluminum and stainless steel through a drawing process. The thickness of the freezer door handle 340 is properly adjusted so that a user can easily hold the freezer door handle 340, and the freezer door handle 340 may have a hollow pipe shape. Although the inside of the freezer door handle 340 is hollow, both sides of the freezer door handle 340 fixed to the front surface of the freezer door 320 have accommodation structures for confining handle fixing parts 360.

The handle fixing parts 360 are provided at the front surface of the freezer door 320.

The handle fixing parts 360 are fixed to both sides of the front surface of the freezer door 320 at positions corresponding to both sides of the freezer door handle 340. The handle fixing parts 360 are fixed to a front upper portion of the freezer door 320 so that the freezer door 320 can be easily opened by titling and drawing the freezer door 320 using the freezer door handle 340. Portions of the handle fixing parts 360 are fixed to the front surface of the freezer door 320, and the other portions of the handle fixing parts 360 are protruded from the front surface of the freezer door 320.

Figure 3:
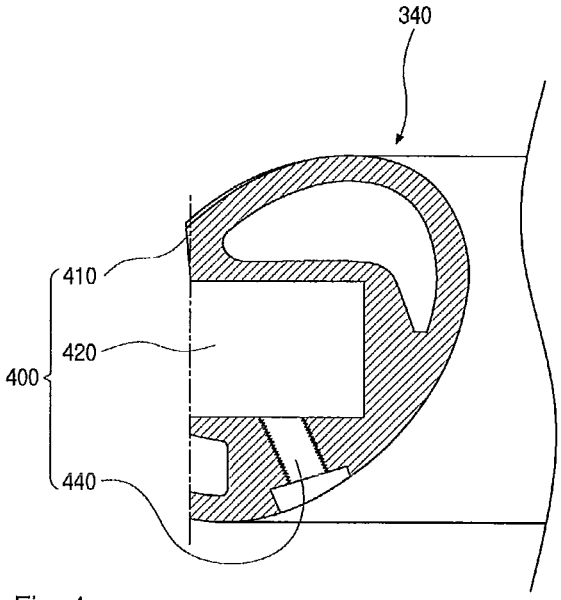
FIG. 3 is a cross-sectional view illustrating a door handle according to an embodiment.
Figure 4:
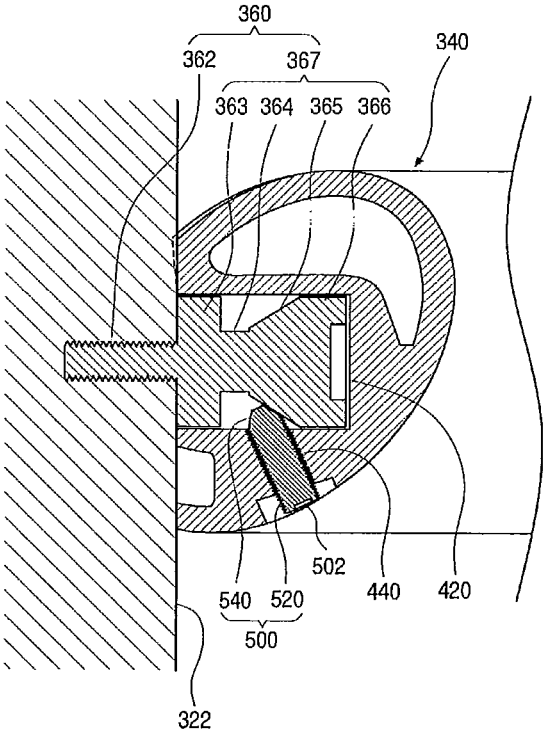
FIG. 4 is a sectional view illustrating a door handle coupling structure according to an embodiment.

FIG. 3 is a cross section illustrating the door handle 430 according to an embodiment. The cross-section of FIG. 3 is taken along line I-I' of FIG. 2. FIG. 4 is a sectional view illustrating a door handle coupling structure according to an embodiment.

The handle fixing parts 360 will now be described in more detail with reference to the accompanying drawings. Each of the handle fixing parts 360 includes a door coupling portion 362 fixed to the front upper portion of the freezer door 320, and a handle insertion portion 367 coupled to the freezer door handle 340. The door coupling portion 362 and the handle insertion portion 367 are formed in one piece.

The door coupling portion 362 has a cylindrical shape having a predetermined length, and the outer surface of the door coupling portion 362 is threaded for being coupled to the front upper portion of the freezer door 320. That is, since the outer surface of the door coupling portion 362 is threaded, the door coupling portion 362 can be fixed to a hole formed in the front upper portion of the freezer door 320 by rotating the door coupling portion 362 in a predetermined direction.

The handle insertion portion 367 protrudes outward from the front upper portion of the freezer door 320. The handle insertion portions 367 of the handle fixing parts 360 are inserted into holders 400 formed at both sides of the freezer door handle 340 and are selectively coupled with detachment preventing parts 500 (described later) so that the freezer door handle 340 can be fixed to the freezer door 320.

The handle insertion portion 367 has a disk shape and is configured by a tight contact portion 363, a connection portion 364, a confinement portion 365, and a head portion 366. When the handle fixing part 360 is fixed to the freezer door 320, the tight contact portion 363 is in tight contact with the front surface of the freezer door 320. The connection portion 364 has a diameter smaller than that of the tight contact portion 363 and extends forward (right in FIG. 4) from the tight contact portion 363. The confinement portion 365 extends forward from an end of the connection portion 364 with an increasing diameter. The head portion 366 extends forward from an end of the confinement portion 365 and makes contact with an inner edge portion of the holder 400.

The outer diameters of the tight contact portion 363 and the head portion 366 may correspond to the inner diameter of the holder 400 such that the tight contact portion 363 and the head portion 366 can be inserted into the holder 400 with no gap therebetween. The confinement portion 365 has an inclined surface such that the confinement portion 365 can make surface contact with the detachment preventing part 500. The slope of the inclined surface of the confinement portion 365 is determined by the distance between the connection portion 364 and the head portion 366 and is corresponding to the slop of a contact surface of the detachment preventing part 500.

A socket may be formed in the head portion 366 so that the handle fixing part 360 can be easily fixed using a screwdriver or wrench.

The holders 400 are disposed at both sides of the freezer door handle 340 for receiving the handle insertion portions 367 of the handle fixing parts 360. The holders 400 are formed by recessing rear surface portions of both sides of the freezer door handle 340 in a forward direction. The holders 400 may be formed as part of the freezer door handle 340 when the freezer door handle 340 is fabricated, or separately formed and then coupled to the freezer door handle 340.

Each of the holders 400 includes a fixing part insertion hole 420 configured to receive the handle insertion portion 367 of the handle fixing part 360, a detachment preventing part penetration hole 440 configured to receive the detachment preventing part 500 for selectively locking the handle fixing part 360 inserted in the fixing part insertion hole 420, and a reinforcement part 410 located in a side opposite to the detachment preventing part penetration hole 440.

The fixing part insertion holes 420 have a diameter corresponding to the diameter of the handle insertion portions 367 and a depth corresponding to the height of the handle insertion portions 367 ?that is, a protruded height of the handle insertion portion 367 from the front surface of the freezer door 320 when the handle fixing part 360 is fixed to the front surface of the freezer door 320. The fixing part insertion holes 420 are formed in both sides of the freezer door handle 340.

The detachment preventing part penetration hole 440 has a diameter corresponding to the diameter of a coupling portion 520 (described later) of the detachment preventing part 500. The detachment preventing part penetration hole 440 is formed from an outer surface of the freezer door handle 340 to the fixing part insertion hole 420. The inner surface of the detachment preventing part penetration hole 440 is threaded so that the detachment preventing part 500 can be screw coupled to the detachment preventing part penetration hole 440.

The detachment preventing part penetration hole 440 is inclined such that the detachment preventing part 500 can make an acute angle with the front surface of the freezer door 320 when the detachment preventing part 500 is inserted into the detachment preventing part penetration hole 440. For example, the detachment preventing part penetration hole 440 can be formed to make an angle of about 20° with the front surface of the freezer door 320. Therefore, a space for a tool used to fix the detachment preventing part 500 can be sufficiently allowed, and thus the detachment preventing part 500 can be brought into contact with a larger area of the handle fixing part 360 so that shaking or detachment of the freezer door handle 340 can be prevented.

The reinforcement part 410 is formed above the detachment preventing part penetration hole 440. The reinforcement part 410 is formed on an upper side of the fixing part insertion hole 420 that makes contact with the freezer door 320, and is protruded backward more than a lower side of the fixing part insertion hole 420 that makes contact with the freezer door 320. Therefore, when the detachment preventing part 500 is coupled to the detachment preventing part penetration hole 440, pressures applied to the upper and lower sides of the fixing part insertion hole 420 can be balanced, and thus the upper side can be prevented from coming off from the front surface of the freezer door 320.

The reinforcement part 410 is formed from an opened peripheral side of the holder 400 to an upper end of the holder 400, and as it goes upward, the reinforcement part 410 further declines toward the back. Therefore, when the detachment preventing part 500 is fastened, the reinforcement part 410 can absorb pressure.

The detachment preventing part 500 is disposed in the detachment preventing part penetration hole 440 to lock the handle fixing part 360 selectively. The detachment preventing part 500 includes the coupling portion 520 and a contact portion 540. The coupling portion 520 is shaped like a cylinder and has a predetermined diameter and length. The outer surface of the coupling portion 520 is threaded. The contact portion 520 is selectively brought into contact with the confinement portion 365 for locking the handle fixing part 360.

The diameter of the coupling portion 520 corresponds to that of the detachment preventing part penetration hole 440, and the entire outer surface of the coupling portion 520 is threaded, such that the coupling portion 520 can be screw-coupled to the detachment preventing part penetration hole 440. A socket 502 may be formed in an end portion of the coupling portion 520 as shown in FIG. 4 so that a coupling tool such as a hexahedral wrench can be used.

The contact portion 540, which is configured to make contact with the confinement portion 365 of the handle fixing part 360, is formed at an upper end of the coupling portion 520 as shown in FIG. 4. The contact portion 540 has an inclined surface corresponding to the inclined surface of the confinement portion 365. That is, the contact portion 540 is inclined such that the contact portion 540 makes contact with the maximum area of the confinement portion 365 when the detachment preventing part 500 is coupled at an acute angle, and the coupling portion 520 does not make contact with the confinement portion 365 so that abrasion of the coupling portion 520 can be prevented.

Coupling procedures of the freezer door handle 340 will now be described with reference to FIGS. 1 to 4 according to an embodiment.

The freezer door handle 340 is coupled to the freezer door 320 as follows. First, the handle fixing parts 360 are coupled to predetermined left and light positions of the freezer door 320 by fixing the door coupling portions 362 of the handle fixing parts 360 to the front upper surface of the freezer door 320. Then, the freezer door handle 340 is placed close to the freezer door 320 and is then pushed to the freezer door 320 so as to insert the handle insertion portions 367 of the handle fixing part 360 to the holders 400. At this time, both sides of the freezer door handle 340 are in tight contact with the front surface of the freezer door 320. Then, the detachment preventing parts 500 are inserted into the detachment preventing part penetration holes 440 using a coupling tool.

Since the detachment preventing parts 500 are coupled to the detachment preventing part penetration holes 440 at an angle outward from the front surface of the freezer door 320, a coupling tool can be used at an angle outward from the front surface of the freezer door 320, and thus a sufficient space can be allowed for using the coupling tool. Therefore, an operator can easily couple the detachment preventing parts 500 using the coupling tool ?that is, the freezer door handle 340 can be easily coupled.

Since the contact portion 540 of the detachment preventing part 500 is inclined for increasing a contact area between the contact portion 540 and the confinement portion 365 of the handle fixing part 360, the handle fixing part 360 can be securely locked using the detachment preventing part 500, and thus the freezer door handle 340 can be securely fixed to the freezer door 320.

Although a force is applied upward to the freezer door handle 340 when the detachment preventing part 500 is coupled, the freezer door handle 340 is not lift because the reinforcement part 410 protruded backward more than the other portion of the freezer door handle 340 is supported on the front surface of the freezer door 320.

A door handle coupling structure will now be described with reference to FIG. 5 according to another embodiment. Detailed descriptions of the same elements as those of the previous embodiments will be omitted, and the same reference numerals will be used for the same elements.

Figure 5:
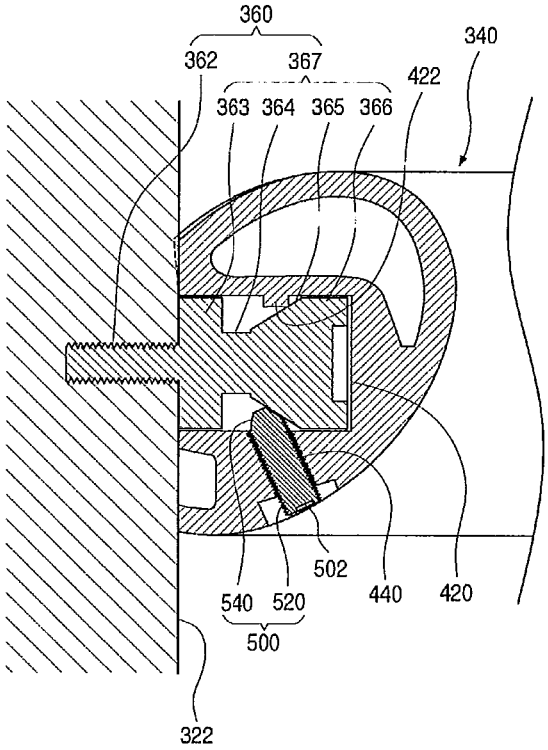
FIG. 5 is a sectional view illustrating a door handle coupling structure according to another embodiment.

FIG. 5 is a sectional view illustrating a door handle coupling structure according to another embodiment.

Referring to FIG. 5, holders 400 (one shown) are disposed at both sides of a freezer door handle 340. Detachment preventing parts 500 are inserted into the holders 400. Each of the holders 400 includes a fixing part insertion hole 420 configured to receive a handle insertion portion 367 of a handle fixing part 360, a detachment preventing part penetration hole 440 configured to receive the detachment preventing part 500 for selectively locking the handle fixing part 360 inserted in the fixing part insertion hole 420, and a reinforcement part 410 configured to press the front surface of a freezer door 320.

A movement restricting part 422 is further formed at the fixing part insertion hole 420 for restricting movement of the handle fixing part 360. The movement restricting part 422 is formed by inwardly protruding an inner peripheral portion of the fixing part insertion hole 420 located opposite to the detachment preventing part penetration hole 440, so as to support a side opposite to a side where a confinement portion 365 of the handle fixing part 360 and a contact portion 540 of the detachment preventing part 500 are in contact, so that the handle fixing part 360 can be locked.

In detail, after the handle fixing part 360 is inserted into the fixing part insertion hole 420, the detachment preventing part 500 is coupled. Then, the contact portion 540 makes surface contact with a portion of the confinement portion 365 of the handle fixing part 360, and a portion of the confinement portion 365 opposite to the portion making contact with the contact portion 540 is in contact with the movement restricting part 422 so that the handle fixing part 360 can be stabled locked.

The freezer door handle 340 of the current embodiment can be attached as follows. The handle fixing parts 360 are coupled to the freezer door 320 by fixing the door coupling portions 362 of the handle fixing part 360 to the freezer door 320. Then, the freezer door handle 340 is placed close to the freezer door 320 and is then pushed to the freezer door 320 so as to insert the handle insertion portions 367 of the handle fixing parts 360 into the fixing part insertion holes 420.

Then, the detachment preventing parts 500 are inserted into the detachment preventing part penetration holes 440 by fastening the detachment preventing parts 500 using a coupling tool.

As the detachment preventing part 500 is inserted, the contact portion 540 formed at an end of the detachment preventing part 500 is brought into contact with the confinement portion 365 of the handle fixing part 360. If the confinement portion 365 and the contact portion 540 have inclined surfaces corresponding to each other, the detachment preventing part 500 and the handle fixing part 360 can make surface contact with each other.

After the detachment preventing part 500 is completely coupled, the movement restricting part 422 makes contact with the confinement portion 365 at a side opposite to the detachment preventing part 500 making contact with the confinement portion 365.

That is, since the handle fixing part 360 is fixed by the upper movement restricting part 422 and the lower detachment preventing part 500, the freezer door handle 340 does not come off from the freezer door 320 while the freezer door 320 is opened and closed.

Furthermore, since the reinforcement part 410 of the holder 400 protruded more than the other portion of the holder 400 is brought into contact with the front surface of the freezer door 320, the freezer door handle 340 is not moved relative to the freezer door 320 although a moment is applied to the freezer door handle 340 while the freezer door handle 340 is manipulated.

Although the freezer door handle coupled to the freezer door has been explained in the above embodiments, the scope of the present disclosure can be applied to a refrigerator door.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Industrial Applicability

According to embodiments, when the door handle is coupled, the detachment preventing part can be easily fastened using a coupling tool so the assembling process can be simple, and the door handle can be stable coupled. Therefore, although the door handle is repeatedly used, the door handle does not come off so that the door can be conveniently used and the durability of the door can be increased. Thus, industrial applicability is high.

The invention claimed is:

1. A refrigerator comprising:

a main body configured to form a storage space;

a door configured to selectively open and close the storage space;

a door handle disposed at the door and configured to be grasped by a user for opening and closing the door;

handle fixing parts mounted to the door and protruding from the door to couple with the door handle, the handle fixing parts each comprising:

a door coupling portion having a threaded outer surface to couple to the door;

a door contact portion formed in a disk shape and tightly contacted with the front surface of the door;

a connection portion extended from the contact portion and having a smaller diameter than the contact portion;

a confinement portion extended forward from an end of the connection portion with an increasing diameter to form an inclined surface; and a head portion extended forward from an end of the confinement portion and having a same diameter as the contact portion;

holders disposed at both sides of the door handle for receiving the handle fixing parts;

a penetration hole extending from a surface of the door handle to each holder at an acute angle with a front surface of the door; and a detachment preventing part coupled to each holder by extending through the penetration hole, the detachment preventing part comprising:

a fixing part coupling portion screw-coupled to the penetration hole;

a fixing part contact portion formed at an upper end of the fixing part coupling portion and having an inclined surface corresponding to the inclined surface of the confinement portion; and a socket formed in an end portion of the fixing part coupling portion so that a coupling tool can be used, wherein the fixing part contact portion presses the confinement portion so that the door handle is tightly contacted to the front surface of the door when the detachment preventing part is fastened to the penetration hole.

2. The refrigerator according to claim 1, wherein the door coupling portion, door contact portion, connection portion and confinement portion form a handle insertion portion protruding outward from the door and inserted into the holder.

3. The refrigerator according to claim 1, further comprising a fixing part insertion hole in each holder into which the handle fixing part is inserted, wherein the penetration hole is formed from an outer lower side of the door handle at an oblique angle to the fixing part insertion hole so as to receive the detachment preventing part.

4. The refrigerator according to claim 3, wherein the detachment preventing part is a threaded fastener.

5. The refrigerator according to claim 3, further comprising a reinforcement part disposed at an upper side of the holder facing the detachment preventing part, the reinforcement part protruding backwards to keep the door handle in contact with the front surface of the door.

6. The refrigerator according to claim 1, wherein the handle fixing parts are provided at both sides of the door, and the holders are disposed at left and right sides of the door handle.

7. The refrigerator according to claim 1, further comprising a movement restricting part disposed at an inner side of the holder opposite to the detachment preventing part for restricting movement of the handle fixing part.

8. A refrigerator comprising:

a main body configured to form a storage space;

a door configured to selectively open and close the storage space;

a door handle disposed at the door, the door handle formed in a horizontally elongated shape having a hollow space;

handle fixing parts mounted to the door and protruding from the door to couple with the door handle, the handle fixing parts each comprising:

a door coupling portion having a threaded outer surface to couple to the door;

a door contact portion formed in a disk shape and tightly contacted with the front surface of the door;

a connection portion extended from the contact portion and having smaller diameter than the contact portion;

a confinement portion extended forward from an end of the connection portion with an increasing diameter to form an inclined surface; and a head portion extended forward from an end of the confinement portion and having same diameter with the contact portion;

holders formed by recessing end portions of both sides of the door handle for receiving the handle fixing parts;

a penetration hole extending from a surface of the door handle to each holder at an acute angle with a front surface of the door; and a detachment preventing part coupled to each holder from the outside toward a front surface of the door, the detachment preventing part comprising:

a fixing part coupling portion screw-coupled to the penetration hole;

a fixing part contact portion formed at an upper end of the fixing part coupling portion and having an inclined surface corresponding to the inclined surface of the confinement portion; and a socket formed in an end portion of the fixing part coupling portion so that coupling tool can be used, wherein the fixing part contact portion presses the confinement portion so that the door handle is tightly contacted to the front surface of the door when the detachment preventing part is fastened to the penetration hole, wherein the door handle is formed of metal, and wherein the holders and an elongated cavity inside of the door handle are formed as one body as part of the door handle through a drawing process.

9. The refrigerator according to claim 8, wherein the confinement portion is inclined to correspond to the fixing part contact portion.

10. The refrigerator according to claim 8, wherein the door handle comprises fixing part insertion holes for receiving the handle fixing parts.

11. The refrigerator according to claim 10, wherein the penetration hole is formed in an outer surface of the door handle at an oblique angle to the fixing part insertion hole.

12. The refrigerator according to claim 11, further comprising a reinforcement part disposed at a side of the door handle opposite to the detachment preventing part penetration hole, the reinforcement part protruding backwards so as to bring the door handle into contact with a front surface of the door when the detachment preventing part is coupled.

13. The refrigerator according to claim 8, further comprising a movement restricting part for restricting movement of the handle fixing part disposed at an inner side of the holder opposite to the detachment preventing part.

* * * * *